US008378906B2

(12) United States Patent
Sato et al.

(10) Patent No.: US 8,378,906 B2
(45) Date of Patent: Feb. 19, 2013

(54) ELECTRICAL CONNECTION STRUCTURE AND ANTENNA APPARATUS

(75) Inventors: Kyuichi Sato, Oga (JP); Hiroshi Suzuki, Akita (JP); Kenichi Kamada, Akita (JP); Takao Kato, Oga (JP)

(73) Assignee: Mitsumi Electric Co., Ltd., Tama-Shi (JP)

( * ) Notice: Subject to any disclaimer, the term of this patent is extended or adjusted under 35 U.S.C. 154(b) by 440 days.

(21) Appl. No.: 12/412,501

(22) Filed: Mar. 27, 2009

(65) Prior Publication Data

US 2010/0149070 A1 Jun. 17, 2010

(30) Foreign Application Priority Data

Dec. 12, 2008 (JP) ..... 2008-316565

(51) Int. Cl.
*H01Q 1/32* (2006.01)

(52) U.S. Cl. ..... 343/713; 343/711

(58) Field of Classification Search ..... 343/711, 343/712, 713
See application file for complete search history.

(56) References Cited

U.S. PATENT DOCUMENTS 5,451,967 A 9/1995 Ueda et al.
7,304,614 B2 * 12/2007 Silva ..... 343/713

FOREIGN PATENT DOCUMENTS

FR 2 794 281 A1 12/2000
FR 2794281 A1 * 12/2000
JP 7-094929 A 4/1995
JP 8-107285 A 4/1996
JP 8-148734 A 6/1996
JP 2000-068722 A 3/2000
JP 2000068722 A * 3/2000
JP 2006-260842 A 9/2006

OTHER PUBLICATIONS

Japanese Office Action dated Sep. 21, 2010 (and English translation thereof) in counterpart Japanese Application No. 2008-316565.

German Office Action dated Sep. 23, 2009 and English translation thereof issued in a counterpart German Application No. 10 2009 015 346.2.

Japanese Office Action dated Nov. 20, 2012 (and English translation thereof) in counterpart Japanese Application No. 2010-258431.

* cited by examiner

*Primary Examiner* — Jacob Y Choi
*Assistant Examiner* — Kyana R McCain
(74) *Attorney, Agent, or Firm* — Holtz, Holtz, Goodman & Chick, PC

(57) ABSTRACT

An electrical connection structure including: a first terminal attached to an edge portion of a circuit board, and composed of a first nipping portion, a connecting portion, a second nipping portion and a leaf spring portion each formed integrally in order as a single member, wherein the connecting portion exists along a side face of the edge portion, the first and second nipping portion and the connecting portion hold the edge portion therebetween and the leaf spring portion extends from an opposite side to the side of the connecting portion of the second nipping portion so that an interior angle formed by the second nipping portion and the leaf spring portion to be an acute; and a second terminal to be electrically connected to the leaf spring portion, wherein the second terminal is pressed to the leaf spring portion into a direction of widening the interior angle.

6 Claims, 5 Drawing Sheets

ELECTRICAL CONNECTION STRUCTURE AND ANTENNA APPARATUS

BACKGROUND OF THE INVENTION

1. Field of the Invention

The present invention relates to an electrical connection structure and an antenna apparatus, and more particularly to an electrical connection structure and antenna apparatus, each including a terminal that does not easily come off from a circuit board.

2. Description of Related Art

Various members, including an AM/FM board for receiving the signals in the AM radio frequency band and the FM radio frequency band and a Global System for Mobile Communications (GSM) board for receiving the signals of portable wireless telephones, are attached on the inside of an antenna apparatus. Accordingly, in order to achieve the miniaturization of the antenna apparatus, the technique of arranging these boards within the apparatus in their standing states has been used.

If the boards are arranged in the standing states, then it becomes difficult to electrically connect an antenna element, located in the upper part of the antenna apparatus, to the boards. Consequently, a connection terminal for connecting the boards to the antenna element electrically becomes necessary, and a technique pertaining to the connection terminal is described in Japanese Patent Application Laid-Open Publication No. 2000-068722.

By the technique described in Japanese Patent Application Laid-Open Publication No. 2000-068722, a connection terminal (7) is attached to the top end of an adjustment board (9) in order to connect the adjustment board (9), attached to a base (3) in the state of standing almost perpendicularly to the base (3), to an antenna element (1). A locking part and a projecting part are formed on the edge of the connection terminal (7), and the connection terminal (7) is fixed almost perpendicularly to the adjustment board (9) with the locking part hitched to the end face on the upper-side of the adjustment board (9) and with the projecting part inserted into one surface of the adjustment board (9). An element connect ion metal fixture (2e) for the connection with the antenna element (1) abuts against the connection terminal (7) from above the connection terminal (7), and thereby the adjustment board (9) is electrically connected to the antenna element (1).

However, the connection terminal fixing method described above has the possibility of the coming-off of the connection terminal (7) from the adjustment board (9) when the antenna element (1) and the supporting metal fixture thereof are strongly pressed to the connection terminal (7). Consequently, it is desired that the connection terminal (7) is firmly fixed to the adjustment board (9).

SUMMARY OF THE INVENTION

Accordingly, the present invention is directed to the firm fixation of the connection terminal to the edge portion of the adjustment board.

According to a first aspect of the present invention, there is provided an electrical connection structure including: a circuit board; a first terminal attached to the circuit board; and a second terminal to be connected to the first terminal, wherein the first terminal includes: a locking part provided to extend from one surface side of the circuit board to the other surface side thereof between both the surfaces of the circuit board along a side edge surface thereof; a first nipping piece connected to the locking part on the one surface side of the circuit board, the first nipping piece provided along one surface of the circuit board; a second nipping piece connected to the locking part on the other surface side of the circuit board, the second nipping piece provided along the other surface of the circuit board to nip the circuit board between the first nipping piece and the second nipping piece; and a leaf spring portion connected to the second nipping piece to be bent toward a second nipping piece side at its connecting portion, wherein the second terminal is pressed to the leaf spring portion into a direction of widening an interior angle formed by the second nipping piece and the leaf spring portion.

According to a second aspect of the present invention, there is provided an antenna apparatus, including: a base; a cover to cover the base from above; a circuit board housed within the cover in a standing state on the base; a first terminal attached to the circuit board; a second terminal piercing through the cover above the circuit board to be electrically connected to the first terminal; and an antenna element attached to the second terminal on the outside of the cover, wherein the first terminal includes: a locking part provided to extend from one surface side of the circuit board to the other surface side thereof between both the surfaces thereof along an upper end surface thereof; a first nipping piece connected to the locking part on the one surface side of the circuit board, the first nipping piece provided along the one surface of the circuit board; a second nipping piece connected to the locking part on the other surface side of the circuit board, the second nipping piece provided along the other surface of the circuit board to nip the circuit board between the first nipping piece and the second nipping piece; and a leaf spring portion connected to the second nipping piece to be bent to the second nipping piece side at its connecting portion, wherein the second terminal is pressed by the leaf spring portion into a direction of widening an interior angle formed by the second nipping piece and the leaf spring portion.

According to a third aspect of the present invention, there is provided an electrical connection structure including: a first terminal attached to an edge portion of a circuit board, and composed of a first nipping portion, a connecting portion, a second nipping portion and a leaf spring portion each formed integrally in order as a single member, wherein the connecting portion exists along a side face of the edge portion, the first and second nipping portion and the connecting portion hold the edge portion of the circuit board therebetween and the leaf spring portion extends from an opposite side to the side of the connecting portion of the second nipping portion so that an interior angle formed by the second nipping portion and the leaf spring portion to be an acute angle; and a second terminal to be electrically connected to the leaf spring portion of the first terminal, wherein the second terminal is pressed to the leaf spring portion into a direction of widening the interior angle.

According to the above aspects, the first nipping piece and the second nipping piece contact with the circuit board, and the second terminal is pressed to the leaf spring portion. Thereby, the second terminal can be electrically connected to the circuit board.

Moreover, the second terminal is pressed to the leaf spring portion into the direction of widening the interior angle formed by the leaf spring portion and the second nipping piece, and thereby the second nipping piece is pressed toward the circuit board around the connecting portion thereof with the locking part as a fulcrum. Consequently, the force to nip the circuit board with the first nipping piece and the second nipping piece becomes stronger. Consequently, even if the leaf spring portion is strongly pressed by the second terminal, the first terminal does not come off from the circuit board.

Moreover, the first terminal is attached to the edge portion of the circuit board in a way of covering the circuit board, and the second terminal abuts against the leaf spring portion of the first terminal from the direction of being opposed to the side edge surface of the circuit board. Consequently, the first terminal does not easily come off.

Preferably, the leaf spring portion of the electrical connection structure is turned up to the second nipping piece side, and a tip portion of the leaf spring portion projects from one end face of the circuit board.

Since the tip portion of the leaf spring portion projects from the side edge of the circuit board to the outside of the side edge thereof, the second terminal can be disposed at a position separated from the side edge surface of the circuit board. Moreover, the second terminal can be disposed at a position opposed to the side edge surface of the circuit board.

Preferably, the tip portion of the leaf spring portion of the electrical connection structure branches into a plurality of branches.

Since the tip portion of the leaf spring portion branches into the plurality of branch portions, each of these branched branch portions can independently deform. If the second terminal abuts against a branch portion and does not abut against the other branch portions, then the branch portion that is pressed in deforms when the branch portion is pressed in. Then, since the second terminal can also abut against the other branch portions, the electric connectivity of the electrical connection structure is improved.

Preferably, the electrical connection structure further includes a projection provided to the second nipping piece to project from the second nipping piece to the other surface side of the circuit board.

The provision of the further projection to the second nipping piece makes the force of nipping the circuit board with the first nipping piece and the second nipping piece stronger. Moreover, the provision makes it easy to produce the electric connection between the circuit board and the first terminal.

Preferably, the first nipping piece of the electrical connection, structure is joined to the one surface of the circuit board.

The joining of the first nipping piece to the circuit board makes the first terminal fixed to the circuit board strongly and makes the first terminal not easy to come off from the circuit board.

Preferably, two of the circuit boards are provided in the electrical connection structure, the two circuit boards provided in parallel with each other, and two of the first terminals are provided, the two first terminals attached to the respective circuit boards in a state of being shifted from each other as viewed from a position opposed to the side edge surfaces of the two circuit boards.

Since the two first terminals are attached to the circuit boards in the state of being shifted from each other as viewed from the opposed positions, the two circuit boards can be arranged closely, and the apparatus can be miniaturized.

According to the present invention, the first terminal is strongly fixed to the circuit board. Consequently, the first terminal does not easily come off from the circuit board.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

In the following, the preferred embodiment of the present invention will be described in detail with reference to the attached drawings.

Incidentally, although the embodiment to be described in the following includes various technically preferable limitations for implementing the present invention, these limitations do not limit the scope of the invention to the following embodiment and shown examples.

Figure 1:
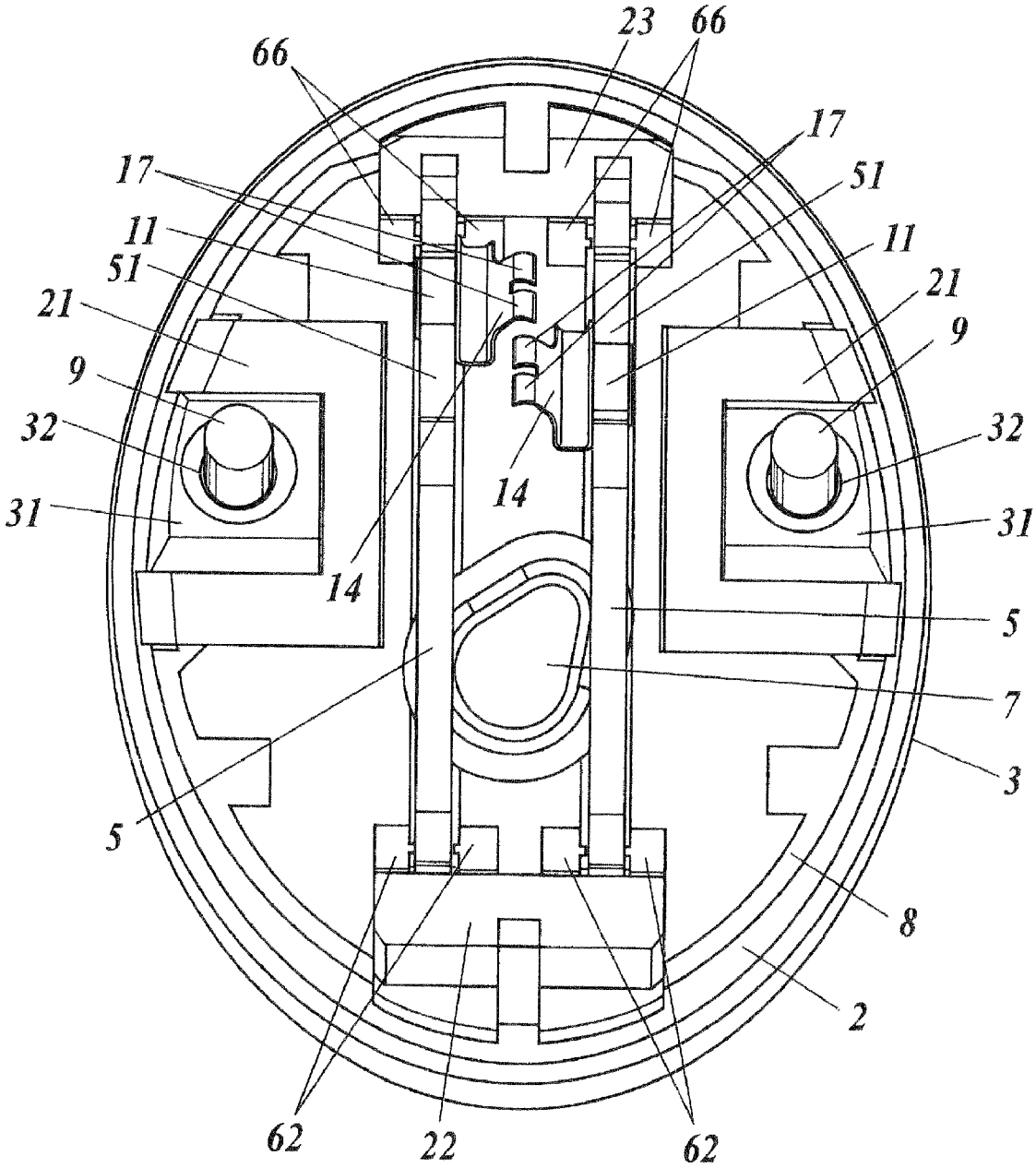
FIG. 1 is a perspective view showing the antenna apparatus with a cover removed as viewed from obliquely upward according to an embodiment of the present invention.
Figure 2:
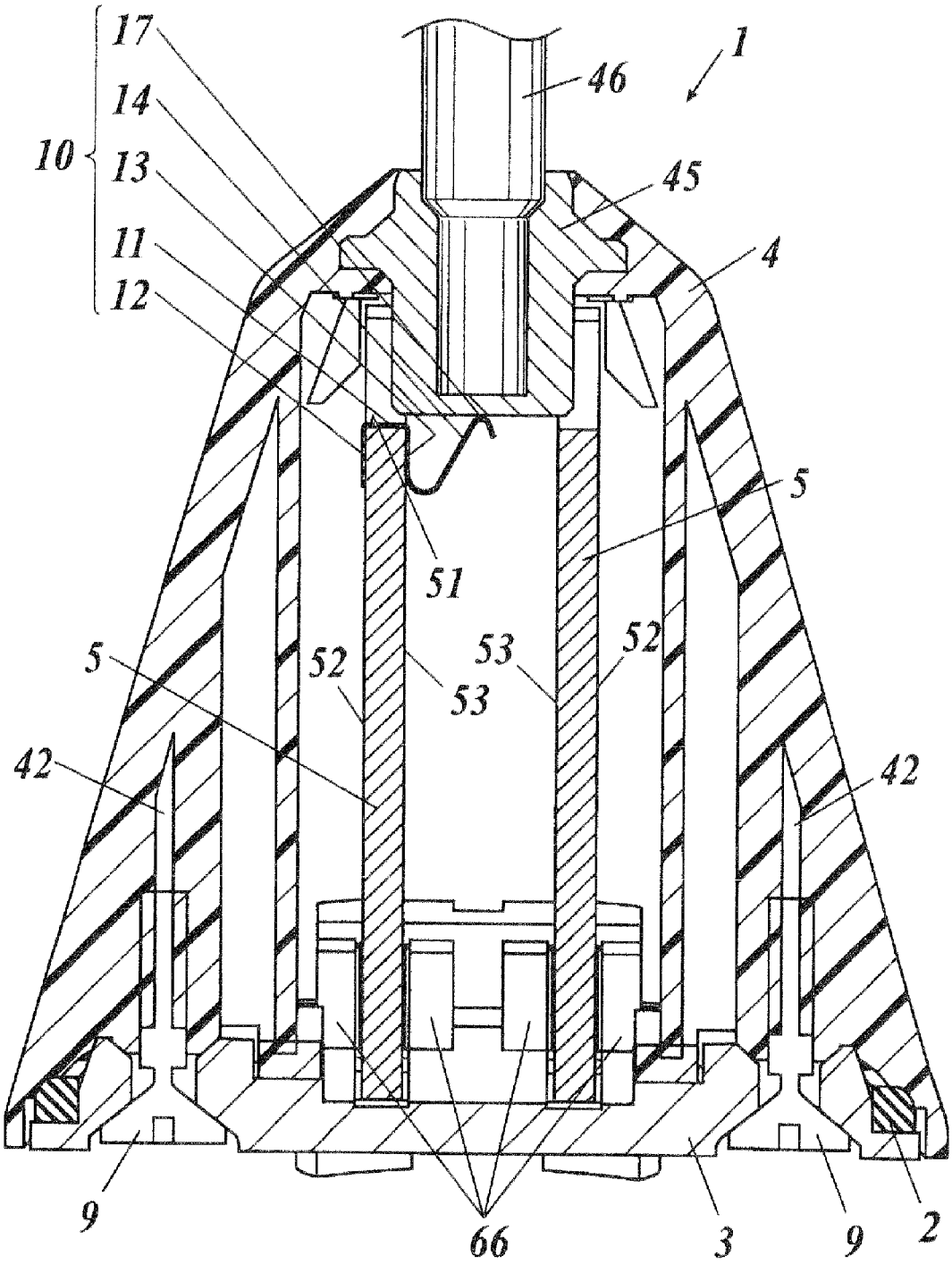
FIG. 2 is a sectional view showing the antenna apparatus as viewed from the front thereof according to an embodiment, of the present invention.
Figure 3:
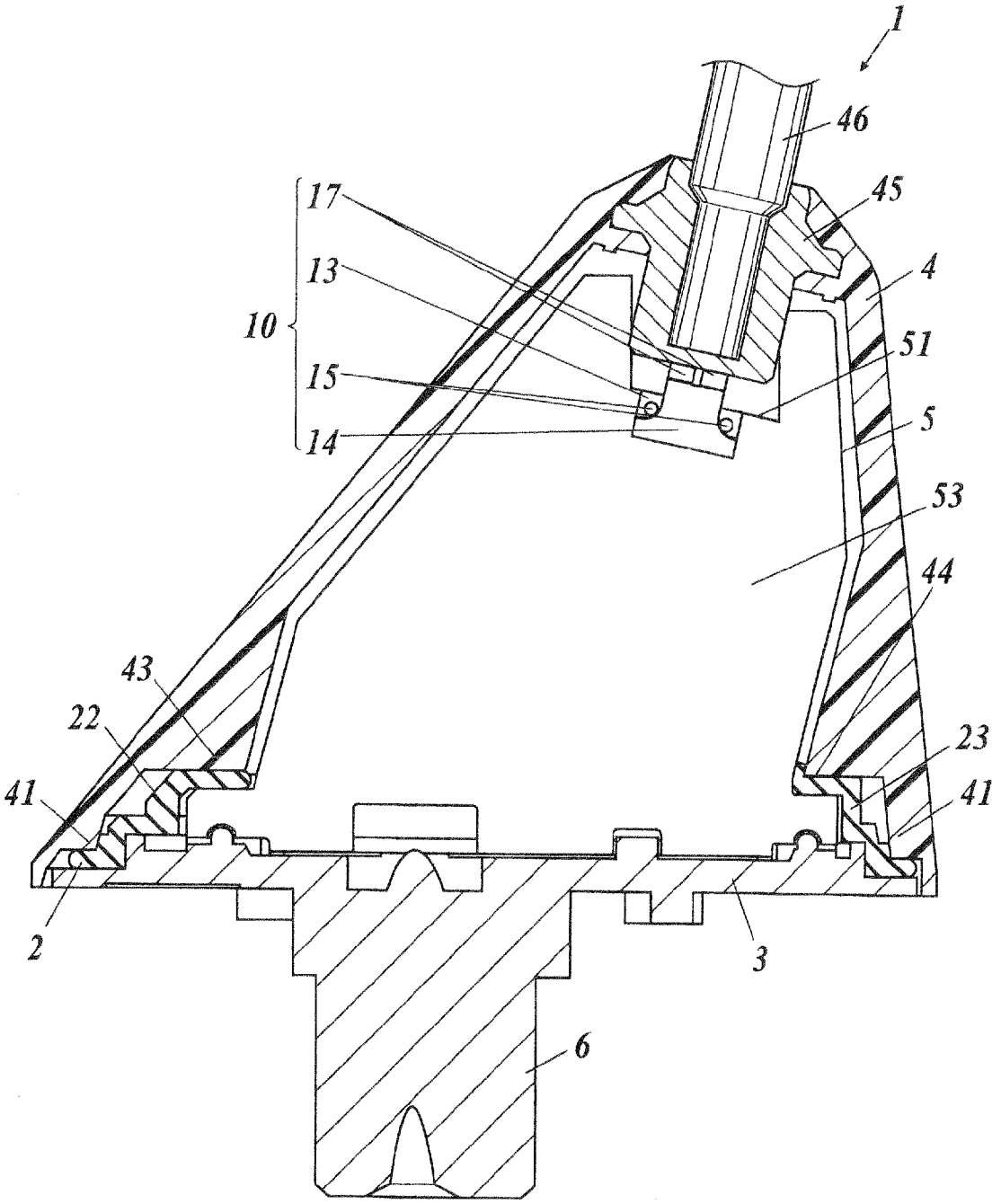
FIG. 3 is a sectional view showing the antenna apparatus as viewed from a side thereof according to an embodiment of the present invention.

FIGS. 1~3 show an antenna apparatus 1 having an electrical connection structure according to an embodiment of the present invention. FIG. 1 is a perspective view showing the antenna apparatus 1 with a cover 4 removed as viewed from obliquely upward; FIG. 2 is a sectional view showing the antenna apparatus 1 as viewed from the front thereof; and FIG. 3 is a sectional view showing the antenna apparatus 1 as viewed from a side thereof. The antenna apparatus 1 is attached to the roof of an automobile, the roof of a vehicle, and the other installation sites.

In the antenna apparatus 1, a gasket 2 is installed on the edge portion of the upper surface of a plate-like base 3, and the cover 4 covers the base 3 from the above thereof. The rubber gasket 2 is nipped between the cover 4 and the base 3, and two circuit boards 5 are housed on the inside of the cover 4.

The base 3 is formed in an ellipse. An insertion portion 6 is formed on the under surface of the base 3 to be in a convex, and a wiring hole 7 pierces through the insertion portion 6 from the tip thereof to the upper surface of the base 3. Wiring is inserted through the wiring hole 7.

A projecting part 8 is formed on the upper surface of the base 3 to be in a convex. The projecting part 8 is formed along the edge of the upper surface of the base 3 to be in a frame. On the other hand, the gasket 2 is formed in a ring, and the projecting part 8 is fitted into the gasket 2. Consequently, the gasket 2 is placed on the upper surface of the base 3 to enclose the projecting part 8.

The base 3, the insertion portion 6, and the projecting part 8 are integrally molded. The base 3, the insertion portion 6, and the projecting part 8 are made of a conducting material, and especially made of a metallic material, such as zinc and aluminum.

The cover 4 is formed in a cone, and the lower side of the cover 4 is opened. A supporting metal fixture 45 (second terminal) is provided at the peak of the cover 4, and a rod-like antenna element 46 is installed in the supporting metal fixture 45. The supporting metal fixture 45 vertically pierces through the peak of the cover 4, and the supporting metal fixture 45 and the cover 4 are integrally formed.

The base 3 is fitted into the opening at the lower part of the cover 4, and the opening is blockaded by the base 3. A stepped portion 41 is formed on an inner wall of the cover 4 in the neighborhood of the opening at the lower part thereof. The stepped portion 41 is formed in a ring along the opening at the lower part of the cover 4. The gasket 2 is nipped between the stepped portion 41 and the edge portion of the upper surface of the base 3. The water cutoff performance and airtightness of the antenna apparatus 1 is kept by the gasket 2.

Moreover, two pedestals 31 are formed on the upper surface of the base 3 in convexes, and through-holes 32 pierce through the base 3 from the under surface thereof to the upper surface of the pedestals 31. Two female screws 42 are formed on the inner wall of the cover 4 by an assembly method, which will be described below. The female screws 42 are located at the positions corresponding to those of the through-holes 32, and male screws 9 are inserted into the through-holes 32 from below the base 3 to be screwed into the female screws 42. By tightening the male screws 9, the cover 4 is attracted to the upper surface of the base 3, and the gasket 2 is compressed by the cover A and the upper surface of the base 3.

In the state in which the base 3 is covered by the cover 4, the center line of the conically-shaped cover 4 is oblique to the upper surface of the base 3, and the centers of axles of the male screws 9 are almost parallel to the center line of the cover 4.

Seals 21 are provided on the peripheries of the pedestals 31, and the through-holes 32 are enclosed by the seals 21. The seals 21 are made of rubber, and are integrally molded with the gasket 2. The seals 21 are nipped between parts of the base 3 and parts of the cover 4 similarly to the gasket 2, and the water cutoff performance and the airtightness of the peripheries of the through-holes 32 are thereby kept.

Couples of ribs 62 are provided in convexes on right and left sides on the front side of the upper surface of the base 3, and couples of ribs 66 are provided in convexes on right and left sides on the rear side of the upper surface of the base 3. The front part of the lower end of one of the circuit boards 5 is nipped by a couple of ribs 62, and the rear part of the lower end of the circuit board 5 is nipped by a couple of ribs 66. Thereby, the circuit board 5 is stood on the upper surface of the base 3. The front part of the lower end of the circuit board 5 is pressed toward the side of the base 3 by a pressing portion 43 on the inner surface of the cover 4 with an elastic piece 22 put between the front part and the pressing portion 43, and the rear part, of the lower end of the circuit board 5 is pressed toward the side of the base 3 by a pressing portion 44 on the inner surface of the cover 4 with an elastic piece 23 put between the rear part and the pressing portion 44. Thereby, the circuit board 5 is supported. The pressings of the pressing portions 43 and 44 come into effect by the clampings of the male screws 9. The other circuit board 5 is similarly stood on the base 3, and the two circuit boards 5 are provided in parallel with each other. Incidentally, the elastic pieces 22 and 23 are integrally formed together with the gasket 2.

A branching circuit, an amplifying circuit, and the like, are installed on the circuit boards 5. One of the two circuit boards 5 is one for AM/FM wave receiving, and the other is one for GSM receiving. The systems and standards of the electric waves processable by these circuit boards 5 are not limited to the AM/FM and GSM, but other ones can be used.

A connection terminal 10 (first terminal) is attached to the top end of each of the two circuit boards 5. The connection, terminal 10 abuts against the supporting metal fixture 45 (second terminal) to connect the antenna element 46 with the circuit board 5 electrically.

Figure 4A:
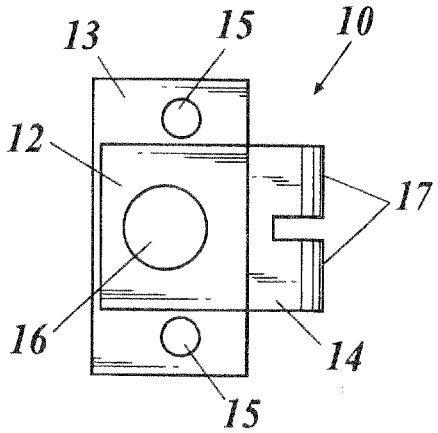
FIG. 4A is a side view showing the connection terminal provided with the antenna apparatus according to an embodiment of the present invention.
Figure 4B:
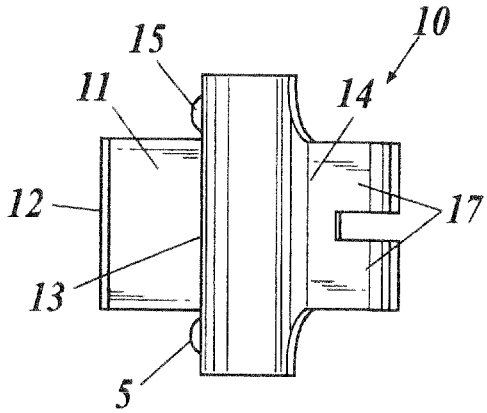
FIG. 4B is a bottom view showing the connection terminal provided with the antenna apparatus according to an embodiment of the present invention.
Figure 4C:
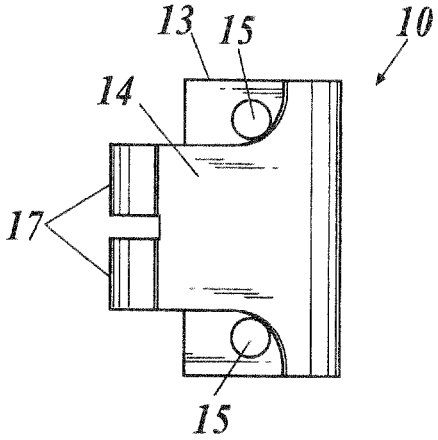
FIG. 4C is another side view showing the connection terminal provided with the antenna apparatus according to an embodiment of the present invention.
Figure 4D:
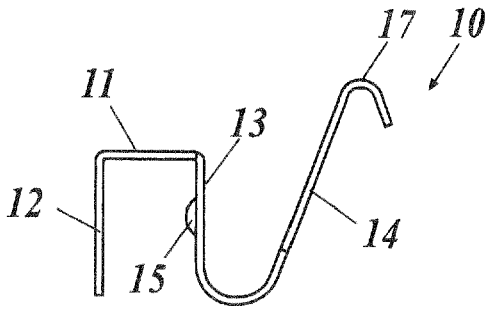
FIG. 4D is a front view showing the connection terminal provided with the antenna apparatus according to an embodiment of the present invention.

FIGS. 4A-4D are views showing the connection terminal 10. FIG. 4A is a side view thereof; FIG. 4B is a bottom view thereof; FIG. 4C is another side view thereof; and FIG. 4D is a front view thereof. In the following, the connection terminal 10 will be described.

The connection terminal 10 is a sheet metal-shaped member made of a conducting material. The connection terminal 10 includes a locking part (connecting portion) 11, a nipping piece 12 (first nipping piece/first nipping portion), a nipping piece 13 (second nipping piece/second nipping portion), and a leaf spring portion 14, and these components are integrally formed.

The nipping pieces 12 and 13 are severally connected to both the ends of the locking part 11 on the right and left sides. The locking part 11 is bent to be almost perpendicular to the nipping piece 12 at the upper end of the nipping piece 12, and the nipping piece 13 is bent to be almost perpendicular to the locking part 11 at the right end of the locking part 11. The nipping piece 12 and the nipping piece 13 are opposed to each other, and they are provided to be almost parallel with each other. The interval between the nipping piece 12 and the nipping piece 13 is nearly equal to the thickness of the circuit board 5, and the length of the locking part 11 in the right and left side direction thereof is made to correspond to the thickness of the circuit board 5.

A through-hole 16 is formed in the central part of the nipping piece 12. The through-hole 16 is a circular hole piercing through the nipping piece 12 from one surface thereof to the other side surface thereof. Incidentally, the through-hole 16 may not be the circle but may be the other forms, and further the through-hole 16 may not be formed.

A couple of projections 15 are formed on the surface of the nipping piece 13 on the side of the nipping piece 12 between both the surfaces of the nipping piece 13. In the shown example, the two projections 15 are formed by performing press molding of the nipping piece 13 from the surface thereof on the outside toward the surface thereof on the inside or the like. But the method of forming the projections 15 is not limited to the press molding, but the method of attaching projection members on the surface of the nipping piece 13 on the inside thereof by welding or the like may be adopted.

The leaf spring portion 14 is connected to the lower end of the nipping piece 13. The leaf spring portion 14 is turned up from the lower end of the nipping piece 13, and the interior angle formed by the nipping piece 13 and the leaf spring portion 14 is an acute angle. The leaf spring portion 14 is turned up so that the top end of the leaf spring portion 14 may be higher than the upper end of the nipping piece 13 and the locking part 11.

The tip portion 17 of the leaf spring portion 14 curves in a bow, and the tip portion 17 is tuned down. The tip portion 17 of the leaf spring portion 14 branches into two branches. Incidentally, the tip portion 17 of the leaf spring portion 14 may not branch, or may branch into three or more branches. Moreover, the part that branches is not limited to the tip portion 17 of the leaf spring portion 14, but the whole of the leaf spring portion 14 may branch. Furthermore, the nipping piece 13 may branch together with the leaf spring portion 14.

The attachment of the connection terminal 10 to the circuit board 5 is performed with the locking part 11 and the nipping pieces 12 and 13. That is, as shown in FIG. 2, the top end of the circuit board 5 is inserted between the nipping piece 12 and the nipping piece 13. In the state in which the connection terminal 10 is attached to the circuit board 5, the locking part 11 abuts against the upper end surface 51 of the circuit board 5, and the locking part 11 is provided to extend from one surface 52 of the circuit board 5 to the other side surface 53 thereof. The nipping piece 12 extends along the one surface 52 of the circuit board 5 to hang down from the upper edge of the surface 52 to the lower part thereof, and the nipping piece 13 extends along the other surface 53 of the circuit board 5 to hang down from the upper edge of the surface 53 to the lower part thereof. Thus the top end of the circuit board 5 is nipped between the nipping pieces 12 and 13. In the state in which the connection terminal 10 is attached to the circuit board 5, the upper end of the leaf spring portion 14 is situated at a position higher than the upper end surface 51 of the circuit board 5.

Since the projections 15 are provided to the nipping piece 13, the connection terminal 10 elastically deforms so that the nipping pieces 12 and 13 may open from each other, and the connection terminal 10 can be fixed to the circuit board 5 more strongly by the elastic force. Incidentally, concave portions or hole portions may be formed on the other side surface 53 of the circuit board 5 to allow the projections 15 to enter the concave portions or the hole portions. By adopting the configuration allowing the projections 15 to enter the concave portions or the hole portions, it is possible to locate the connection terminal 10 on the surface 53 of the circuit board 5, and to make it more difficult that the connection terminal 10 shifts and comes off.

The nipping piece 12 is soldered to the one surface 52 of the circuit board 5 with solder or the like. Part of the solder is embedded in the through-hole 16.

Figure 5:
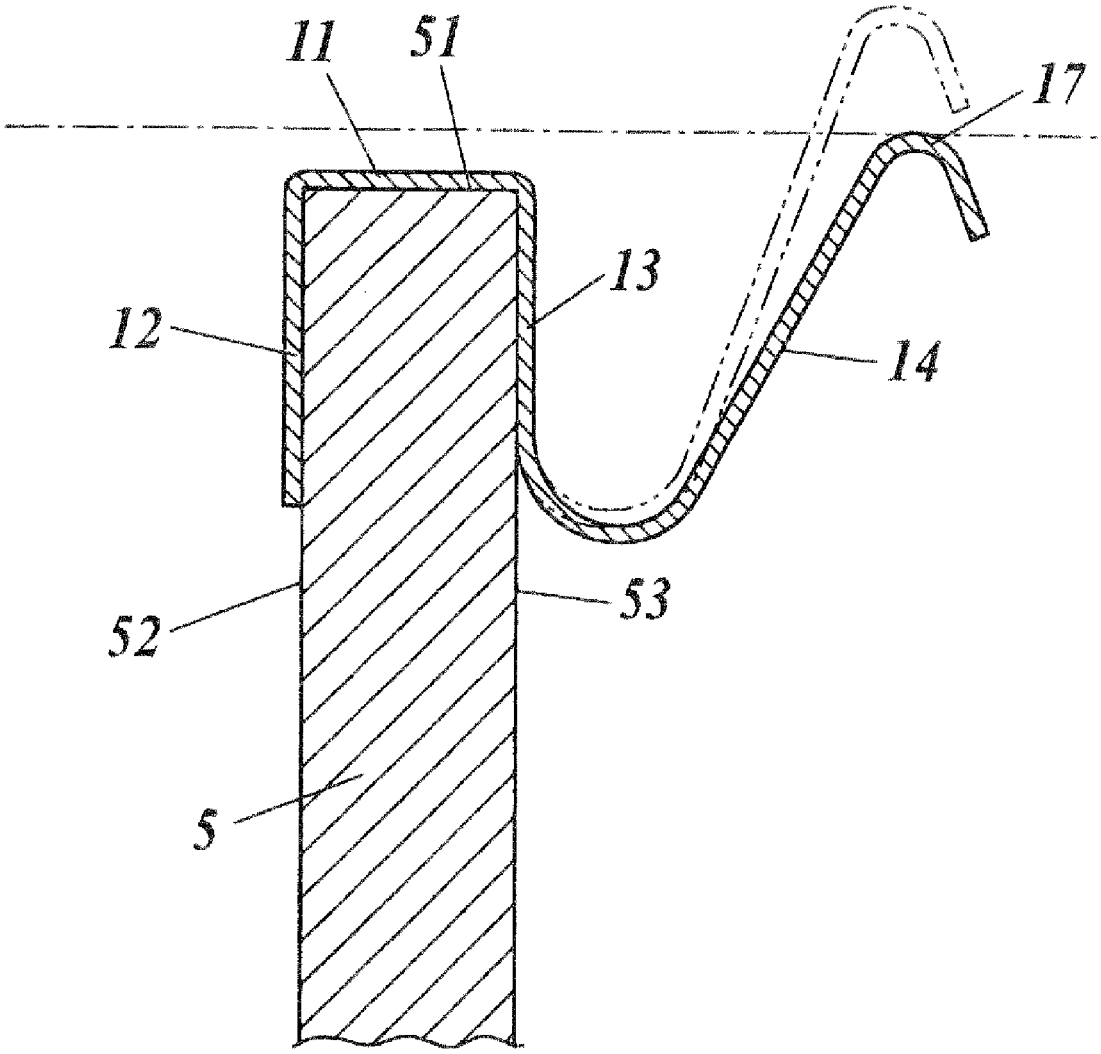
FIG. 5 is a schematic sectional side view of the connection terminal according to an embodiment of the present invention.

FIG. 5 is a schematic sectional side view of the connection terminal 10 and shows the forms before and after the deformation thereof caused by the attachment of the cover 4. The form of the connection terminal 10 before the deformation is shown by a chain double-dashed line and the form of the connection terminal 10 after the deformation is shown by a solid line in FIG. 5. As shown in FIGS. 2, 5, and the like, the lower end surface of the supporting metal fixture 45 abuts against the tip portion 17 of the leaf spring portion 14, and the leaf spring portion 14 is downward pressed in by the supporting metal fixture 45. Consequently, the leaf spring portion 14 elastically deforms, so that the interior angle formed by the leaf spring portion 14 and the nipping piece 13 is widened more than that of the natural state thereof. The contact force between the leaf spring portion 14 and the supporting metal fixture 45 is improved by the elastic force of the leaf spring portion 14.

Since the leaf spring portion 14 is in the state of being downward pressed in, the moment around the top end of the nipping piece 13 as the fulcrum of the moment operates on the nipping piece 13, and the nipping piece 13 is pressed to the circuit board 5. Consequently, the connection terminal 10 does not easily come off from the circuit board 5. Moreover, even if the leaf spring portion 14 is downward pressed in strongly, the nipping piece 13 is supported by the circuit board 5, and consequently the moment into the direction of separating the nipping piece 12 from the one surface 52 of the circuit board 5 hardly operates. Consequently, since the electrical contact between the nipping piece 12 and the circuit board 5 is formed by soldering them to each other, the electrical contact failure thereof is not easily caused.

As shown in FIG. 1, the leaf spring portion 14 of the connection terminal 10 attached to the one circuit board 5 is located on the side of the other circuit board 5, and the leaf spring portion 14 of the connection terminal 10 attached to the other circuit board 5 is similarly located on the side of the one circuit board 5. The position of one of these connection terminals 10 shifts from that of the other one in the front and rear direction here. Since the leaf spring portions 14 of these connection terminals 10 are arranged to be mutually different, these leaf spring portions 14 do not contact with each other. Consequently, the circuit boards 5 can be put close to each other, and then the widths of the base 3 and cover 4 in the right and left side directions can be narrowed to achieve the miniaturization of the antenna apparatus 1. Incidentally, the two connection terminals 10 are arranged so that the supporting metal fixture 45 can contact with both of the two connection terminals 10 when the cover 4 is attached to the base 3.

Since the upper ends of the leaf spring portions 14 are situated at positions higher than the upper end surfaces 51 of both of the circuit boards 5, the supporting metal fixture 45 contacts with the leaf spring portions 14 even if the lower end surface of the supporting metal fixture 45 is not situated at a position lower than the upper end surfaces of the circuit boards 5. Then, since the interval between the two circuit boards 5 can be narrowed than the width of the supporting metal fixture 45, the two circuit boards 5 can be brought close to each other, and the widths of the base 3 and cover 4 in the right and left side directions can be narrowed. Consequently, the miniaturization of the antenna apparatus 1 can be achieved.

A method of manufacturing the antenna apparatus 1 and a method of connecting the circuit boards 5 with the antenna element 46 electrically will be described.

First, the top ends of the circuit boards 5 are severally inserted between the nipping pieces 12 and 13 of the connection terminals 10, and the locking parts 11 are made to abut against the upper end surfaces 51 of the circuit boards 5. Next, solder melts in the through-holes 16, and the nipping pieces 12 and the one surfaces 52 of the circuit boards 5 are soldered together with the solder.

On the other hand, the front parts of the lower ends of the circuit boards 5 are severally inserted between the ribs 62, and the rear parts of the lower ends of the circuit boards 5 are severally inserted between the ribs 66. The front parts of the lower ends of the circuit boards 5 and the ribs 62 are covered by the elastic piece 22, the rear parts of the lower ends of the circuit boards 5 and ribs 66 are covered by the elastic piece 23. Thereby, the circuit boards 5 are supported in the state of standing on the upper surface of the base 3.

Next, the projecting part 8 of the base 3 are fit into the gasket 2, and the gasket 2 is placed on the upper surface of the base 3 on the periphery of the projecting part 8. At this time, the position of the gasket 2 in its circumferential direction is adjusted to place the elastic piece 22 on the ribs 62 and to place the elastic piece 23 on the ribs 66. Then the seals 21 are arranged around the peripheries of the pedestals 31. Since the elastic pieces 22 and 23 are integrally formed with the gasket 2, the positions of the elastic pieces 22 and 23 are determined at the time of the attachment of the gasket 2. Consequently, the construction property of the antenna apparatus 1 is improved.

Next, the cover 4 is covered above the circuit boards 5, and the base 3 is fitted into the opening of the cover 4. Thereby the gasket 2 is nipped between the stepped portion 41 on the inside of the cover 4 and the base 3, and the front parts of the lower ends of the circuit boards 5 and the elastic piece 22 are nipped between the ribs 62 and the pressing portion 43, and further the rear parts of the lower ends of the circuit boards 5 and the elastic piece 23 are nipped between the ribs 66 and the pressing portion 44. Moreover, the supporting metal fixture 45 abuts against the tip portions 17 of the leaf spring portions 14 of the connection terminals 10 at this time. If the lower end surface of the supporting metal fixture 45 inclines to the locking parts 11 of the connection terminals 10, then ones of the tip portions 17, each of which branches into two branches, contact with the lower end surface.

Next, the male screws 9 are inserted, into the through-holes 32 from below the base 3 to be tightened to the female screws 42. As the male screws 9, for example, self-tapping screws are used, and the female screws 42 are formed on the inner surfaces of the through-holes 32 by screwing the self-tapping screws into the through-holes 32. The cover 4 is thus attracted to the upper surface of the base 3, and the elastic pieces 22 and 23, the seals 21 and the gasket 2 are compressed. At the same time, the leaf spring portions 14 are gradually depressed downwards by the supporting metal fixture 45, and the interior angles formed between the leaf spring portions 14 and the nipping pieces 13 are opened. Incidentally, if the lower end surface of the supporting metal fixture 45 inclines to the locking parts 11 of the connection terminals 10, then the tip portions 17 that contact with the supporting metal fixture 45 among the tip portions, each of which branches into two branches, deform, and the supporting metal fixture 45 contacts with both the tip portions 17 of each of the connection terminals 10 in the end.

After that, when the antenna element 46 is attached to the supporting metal fixture 45, then, the circuit boards 5 and the antenna element 46 are electrically connected to each other through the connection terminals 10 and the supporting metal fixture 45, and the antenna apparatus 1 is thus completed.

As described above, according to the present, embodiment, by widening the interior angles formed by the nipping pieces 13 and the leaf spring portions 14 by the tightening of the male screws 9, the moments of the lower parts of the nipping pieces 13 in the directions toward to the circuit boards 5 operate to the nipping pieces 13 around the connecting portions of the nipping pieces 13 and the locking parts 11 as fulcra. Consequently, the circuit boards 5 are strongly nipped by the nipping pieces 12 and the nipping pieces 13. Thereby the connection terminals 10 are strongly fixed to the circuit boards 5 (see FIG. 5; after deformation). In particular, as the supporting metal fixture 45 is depressed downward more and more, the nipping by the nipping pieces 12 and the nipping pieces 13 become stronger, and the connection terminals 10 are strongly fixed. Consequently, even if the supporting metal fixture 45 is unexpectedly pressed downward because the tightening of the male screws 9 becomes stronger owing to an erroneous design, the connection terminals 10 do not come off from the circuit boards 5.

Moreover, the supporting metal fixture 45 depresses the leaf spring portions 14 into the direction of widening the interior angles, and the forces of restoring the interior angles to the original angles against the movements work on the leaf spring portions 14. Consequently, the supporting metal fixture 45 abuts against the tip portions 17 more strongly, and the electric connections between them become more secure.

Moreover, the connection terminals 10 are attached to the circuit boards 5 so as to cover the circuit boards 5 from above, and the contact of the supporting metal fixture 45 with the connection terminals 10 is made from above. Consequently, the connection terminals 10 do not easily come off.

Incidentally, the present invention is not limited to the embodiment described above, and various improvements and changes of the design may be performed without departing from the sprit and scope of the present invention.

For example, the interior angles formed by the nipping pieces 13 and the leaf spring portions 14 may be obtuse angles, and the front edges of the leaf spring portions 14 may be located at positions lower than the upper end surfaces of the circuit boards 5. In this case, the lower end surface of the supporting metal fixture 45 contacts with the leaf spring portions 14 at the positions lower than the upper end surfaces 51 of the circuit boards 5.

Moreover, although the two circuit boards 5 are provided in the present embodiment, the circuit board may be one, or further many circuit boards may be provided.

Moreover, although the nipping pieces 12 are fixed to the surfaces 52 by soldering in the present embodiment, the fixation may be performed by the other fixing methods, such as adhesion using an adhesive or the like.

Moreover, an electrical connection structure according to the present invention can be applied to electric apparatus having the configurations of hosing circuit boards in their cases besides the antenna apparatus.

The entire disclosure of Japanese Patent Application No. 2008-316565 filed on Dec. 12, 2008 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. An antenna apparatus comprising:

a base;

a cover which is fittable to the base;

a tightening unit for tightening the base and the cover in a state of being fitted with each other;

a circuit board housed in an internal space formed by the base and the cover;

a supporting unit for supporting the circuit board in a standing state on the base;

a first terminal attached to an upper end portion of the circuit board, the first terminal including:

a locking part abutting against an upper end surface of the circuit board;

a first nipping piece connected to the locking part and being provided along a first surface of the circuit board;

a second nipping piece connected to the locking part and being provided along a second surface of the circuit board such that the circuit board is nipped between the first nipping piece and the second nipping piece; and a leaf spring portion connected to the second nipping piece and bent toward the second nipping piece at its connecting portion, wherein at least a tip portion of the leaf spring portion has a total width which is shorter than the connecting portion in a direction along the upper end surface of the circuit board;

a second terminal electrically connected with the first terminal, the second terminal piercing through the cover above the circuit board; and an antenna element attached to the second terminal from an outside of the cover;

wherein the base is tightened with the cover by the tightening unit whereby the circuit board is fixed on the base in the standing state and the first terminal is electrically connected with the second terminal; and wherein the second terminal is pressed against the tip portion of the leaf spring portion in a direction such that an interior angle formed by the second nipping piece and the leaf spring portion is widened.

2. The antenna apparatus according to claim 1, wherein the tip portion of the leaf spring portion bent toward the second nipping piece projects higher than the upper end surface of the circuit board.

3. The antenna apparatus according to claim 1, wherein the tip portion of the leaf spring portion branches into a plurality of branches.

4. The antenna apparatus according to claim 1, further comprising a projection provided to the second nipping piece so as to project from the second nipping piece toward the second surface side of the circuit board.

5. The antenna apparatus according to claim 1, wherein the first nipping piece is joined to the first surface of the circuit board.

6. The antenna apparatus according to claim 1, wherein:

two of the circuit boards are provided, the two circuit boards being provided in parallel with each other, and two of the first terminals are provided, the two first terminals being attached to the respective circuit boards in a state such that they are shifted with respect to each other as viewed from a position opposing the side edge surfaces of the two circuit boards.

* * * * *